United States Patent [19]

Topholm

[11] Patent Number: 4,575,586

[45] Date of Patent: Mar. 11, 1986

[54] APPARATUS FOR USE IN THE ADJUSTMENT OF THE SECONDARY ADJUSTMENT MEANS OF A HEARING AID

[75] Inventor: Christian Topholm, Vaerlose, Denmark

[73] Assignee: Topholm & Westermann APS, Erlose, Denmark

[21] Appl. No.: 626,875

[22] PCT Filed: Nov. 4, 1983

[86] PCT No.: PCT/DK83/00103

§ 371 Date: Jul. 3, 1984

§ 102(e) Date: Jul. 3, 1984

[87] PCT Pub. No.: WO84/01876

PCT Pub. Date: May 10, 1984

[30] Foreign Application Priority Data

Nov. 5, 1982 [DK] Denmark ..... 4924/82

[51] Int. Cl.[4] ..... H04R 25/00

[52] U.S. Cl. ..... 179/107 H; 179/107 R; 381/69

[58] Field of Search ..... 179/107 H, 107 R, 107 FD; 381/68, 69; 73/585

[56] References Cited

U.S. PATENT DOCUMENTS

| | | | |
|---|---|---|---|
| 3,989,904 | 11/1976 | Rohrer et al. | 179/107 FD |
| 4,099,035 | 7/1978 | Yanick | 179/107 ED |
| 4,114,098 | 9/1978 | Booty | 325/390 |
| 4,396,806 | 8/1983 | Anderson | 179/107 ED |

FOREIGN PATENT DOCUMENTS

| | | | |
|---|---|---|---|
| 2605453 | 5/1978 | Fed. Rep. of Germany . | |
| 3318056 | 11/1984 | Fed. Rep. of Germany | 179/107 R |
| 1569198 | 6/1980 | United Kingdom . | |
| 0862399 | 9/1981 | U.S.S.R. | 381/68 |

*Primary Examiner*—Gene Z. Rubinson
*Assistant Examiner*—Danita R. Byrd
*Attorney, Agent, or Firm*—Lewis H. Eslinger

[57] ABSTRACT

An apparatus for use in adjusting a secondary adjustment device of a hearing aid consists of an adaptor that can be so placed on the hearing aid that the adjustment device of the hearing aid becomes coupled to corresponding moving elements on the adaptor. These moving elements are in turn coupled to their respective activation controls on a control desk through respective wires in a bowden cable, enabling the secondary adjustment device of the hearing aid to be adjusted by manipulating the activation controls at the control desk.

5 Claims, 2 Drawing Figures

Figure 1:
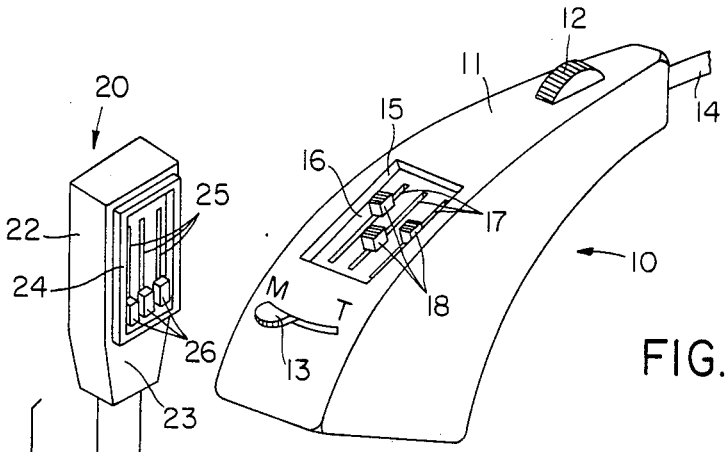

APPARATUS FOR USE IN THE ADJUSTMENT OF THE SECONDARY ADJUSTMENT MEANS OF A HEARING AID

Hearing aids, besides having the adjustment means which the patient frequently wants to operate, such as volume control, contact and switch for switching over from microphone to teleloop, are often equipped with so-called secondary adjustment means serving to vary certain properties of the apparatus, e.g. the tone reproducing characteristic and the maximum sound intensity. These adjustments are usually made once for all when the patient receives the hearing aid in order to adapt properties of the aid as best as possible to the individual requirements of the patient in question.

The adjustment means are often continuously movable, and adjustment is e.g. made by rotating a slotted shaft or by positioning a slidable button. In practice it may be of great importance to the patient's benefit of the hearing aid that optimum adjustment is provided for. There may also be interaction between two or more adjustable characteristics so that it is a matter of finding the optimum combination of adjustments. Thus, it is desirable that the user himself can adapt his aid under ordinary sound conditions or when listening under simulated test situations.

In order for the patient to get the natural hearing impression he must carry the aid in normal position on the head, i.e. either behind the ear, in the ear or in an eyeglass frame. Since, however, the adjustment means are very small and often inaccessible in the position of use, adjustment is made in practice by removing the aid followed by random adjustment and testing, and in most cases removal and random adjustment again, and so on. No matter whether the user himself performs the adjustment in this manner, or whether another person assists him, it is always doubtful whether the optimum adjustment is found.

The invention concerns an apparatus for use in the adjustment of the secondary adjustment means of a hearing aid, and its object is the provision of such an apparatus which enables the user to readily perform such adjustment with the hearing aid in the position of use and under ordinary conditions of listening.

This object is achieved in that it consists of an adaptor which is arranged to be applied to the hearing aid and has one or more moving means which are brought into movement-transmitting communication with one or more corresponding adjustment means of the hearing aid upon application of the adaptor, and a control desk equipped with one or more adjustable activation means and in such communication with the adaptor that movement of the activation means or each activation means thereof causes corresponding movement of the corresponding moving means or each corresponding moving means of the adaptor. This construction allows the manual adjusting process to be moved from the hearing aid itself to the control desk which can be lifted in a convenient position and whose activation means may have a suitable size allowing for ready adjustment.

The secondary adjustment means of the hearing aid are usually gathered on a panel disposed in a recessed opening in the housing of the apparatus, which may be closed by a cover when the adjustment has been performed. When used in connection with such a hearing aid, the housing of the adaptor is expeciently formed with a protruding frame fitting in the opening in the housing of the hearing aid, the moving means or each moving means of the adaptor being placed within said frame.

A particularly simple mechanical embodiment of the apparatus is characterized in that the activation means or each activation means on the control desk is connected with the activation means or with its respective activation means on the adaptor through one or more wires in a bowden cable. More particularly the bowden cable contains a fixed wire for fixing the length. When the activation means or each activation means on the control desk is connected with the corresponding wire in the bowden cable through a movement transforming mechanism, the size and travel of the activation means or each moving means of the control desk may be selected according to the user's wishes.

The movement of the moving means or each moving means of the adaptor may also be controlled electrically from the control desk.

Figure 2:
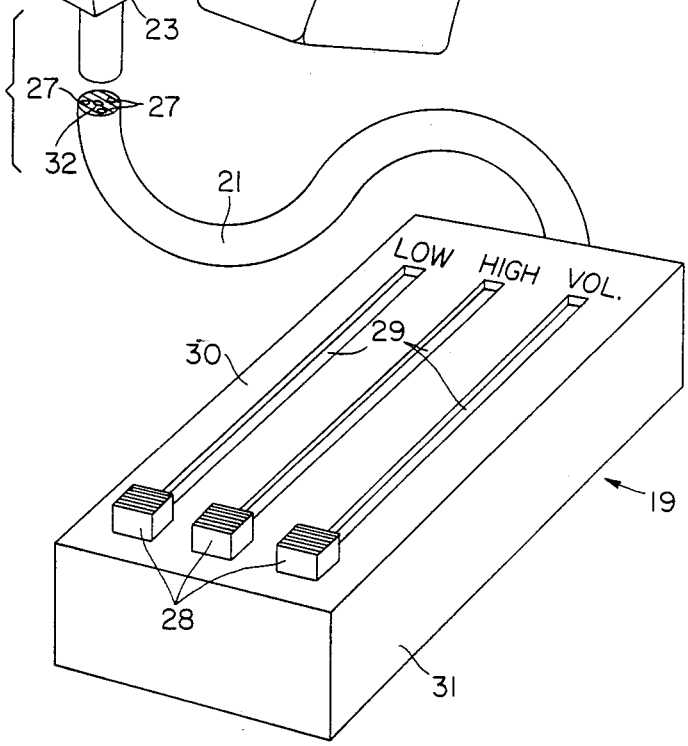

The invention will be explained more fully below with reference to the drawing, in which FIG. 1 is an enlarged perspective view of a hearing aid of the type intended to be worn behind the ear, and FIG. 2 is likewise an enlarged and perspective view of an embodiment of the apparatus of the invention for use in connection with the hearing aid of FIG. 1.

The hearing aid shown in FIG. 1 is generally designated by 10 and has a configuration making it suitable for positioning behind the ear. At the upwardly and obliquely downwardly directed side 11 of the housing the apparatus has an edge-positioned rotary button 12 for volume control and a switch 13 for switching between microphone and teleloop. A hose section 14 forming a sound channel extends from the front end of the housing to an earplug (not shown).

The top side 11 of the housing is moreover formed with a rectangular opening 15 in which a panel 16 is recessed; the panel has three secondary adjustment means which are slidable in slits 17 by manipulation of buttons 18 to adjust slide potentiomers placed in the housing, thereby to regulate e.g. low and high frequencies and maximum intensity.

FIG. 2 shows the adjustment apparatus of the invention which comprises a control desk 19 and an adaptor 20 interconnected through a bowden cable 21.

The adaptor 20 has a substantially box-shaped housing 22, whose front 23 is formed with a protruding, rectangular frame 24 which fits in the opening 15 in the top side 11 of the hearing aid so that the frame is retained in the opening by clamping. The adaptor 20 may in this manner be detachably fixed on the hearing aid 10. Within the frame 24 the front 23 is formed with three slits 25 of the same extent and relative location as the slits 17 in the hearing aid panel 16 and in register with their respective ones of the slits 17 in the applied position of the adaptor. Each slit 25 slidably mounts a moving means 26 in the shape of a forwardly open box which can be moved down over the corresponding adjustment button 18 on the hearing aid.

A wire 27 in the bowden cable 21 connects each moving means 26 with a corresponding activation means 28 slidably fitted in a slit 29 in the top side 30 of the box-shaped housing 31 of the control desk 19. For reasons of convenience and accuracy of adjustment, the activation buttons 28 and their slits 29 have larger dimensions than the moving means 26 of the adaptor and their slits 25, and each wire 27 in the bowden cable 21 is therefore connected with its activation means 28 through a transformation mechanism (not shown) e.g. of the pantograph type, contained in the housing 31.

In addition to the three motion transmitting wires 27 slidable in their respective channels in the bowden cable 21, the cable contains a wire 32 which is fixed in a central channel and fixes the distance between the activation buttons 28 and the moving means, i.e. the length of the cable.

When the hearing aid 10 is to be adapted to a specific patient, the secondary adjustment buttons 18 are first placed at one end of their slits, and the moving means 26 of the adaptor are placed at the corresponding end of their slits 25. When the adaptor frame 24 is then fitted in the opening 15 in the hearing aid housing, the moving means 26 will extend downwards over and thus be coupled to their respective adjustment means 18. The patient now places the hearing aid with the applied adaptor in the normal position of use and can then finely adjust the secondary adjustment means by manipulating the buttons 28 of the control panel under natural or simulated conditions of listening. The desk may optionally also be operated by an assistant. When the optimum adjustment has been found in this manner, the adaptor 20 is removed, and the secondary adjustment means 18 are covered preferably by a cover (not shown) fitted over the opening 15 to protect the adjustment means against unintentional action.

The apparatus of the invention can be constructed in many other ways than the one shown and described in the foregoing. For example, rotary potentiometers with a slot at the end of the shaft may be substituted for the slide potentiometers with linearly movable adjustment buttons, and in that case the moving means on the adaptor are formed by screwdrivers, and the wires of the bowden cable are arranged to transmit a rotary movement from rotary buttons on the control desk. It is also possible to activate the moving means of the adaptor, no matter whether they are slidable or rotary, by remote control from the control desk. Such remote control can take place through electric leads between the desk and the adaptor or wirelessly by means of generally known equipment. Electromagnetic waves or ultrasonic waves may be used for wireless transmission of signals. Also the coupling between the moving means of the adaptor and the secondary adjustment means of the hearing aid may be effected in other ways than those described in the foregoing and shown in the drawing.

I claim:

1. An apparatus for use in the adjustment of a secondary adjustment device on a hearing aid, comprising, an adaptor which is arranged to be applied to the hearing aid and has at least one moving means adapted to be brought into contact with at least one corresponding secondary adjustment means in said secondary adjustment device of the hearing aid for transmitting movement thereto upon application of the adaptor, and a control desk equipped with at least one adjustable activation means remotely located relative to the adaptor and connected with the adaptor so that movement of the activation means of the control desk causes corresponding movement of the moving means of the adaptor.

2. An apparatus according to claim 1, for use in connection with a hearing aid having a housing and in which the secondary adjustment device is placed on a panel which is recessed in an opening in the housing of the hearing aid, characterized in that the adaptor includes a housing formed with a protruding frame fitting in the opening in the housing of the hearing aid, the moving means of the adaptor being placed within said frame of said adaptor housing.

3. An apparatus according to claim 1 or 2, characterized in that the adjustable activation means of the control desk is connected with the respective activation means on the adaptor through at least one wire in a bowden cable.

4. An apparatus according to claim 3 characterized in that the activation means of the control desk is connected with a corresponding wire in the bowden cable through a movement transforming mechanism.

5. An apparatus according to claim 1 or 2, characterized in that the moving means of the adaptor includes operator means controlled electrically from the control desk.

* * * * *